US010812929B1

(12) United States Patent
Donley et al.

(10) Patent No.: US 10,812,929 B1
(45) Date of Patent: Oct. 20, 2020

(54) INFERRING PINNAE INFORMATION VIA BEAM FORMING TO PRODUCE INDIVIDUALIZED SPATIAL AUDIO

(71) Applicant: Facebook Technologies, LLC, Menlo Park, CA (US)

(72) Inventors: Jacob Ryan Donley, Kirkland, WA (US); Pablo Francisco Faundez Hoffmann, Kenmore, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/554,401

(22) Filed: Aug. 28, 2019

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04R 5/027*** | (2006.01) |
| ***H04R 3/12*** | (2006.01) |
| ***H04R 1/40*** | (2006.01) |

(52) U.S. Cl.
CPC ..... *H04S 7/307* (2013.01); *H04R 1/403* (2013.01); *H04R 3/12* (2013.01); *H04R 5/02* (2013.01); *H04R 5/027* (2013.01); *H04R 5/04* (2013.01); *H04S 7/303* (2013.01); *H04S 2400/15* (2013.01); *H04S 2420/01* (2013.01)

(58) Field of Classification Search
CPC ..... H04S 7/307; H04S 7/303; H04S 2400/15; H04S 2420/01; H04S 7/302; H04R 1/403; H04R 3/12; H04R 5/02; H04R 5/027; H04R 5/04; H04R 1/32; H04R 3/005; H04R 2203/12; H04R 2410/01; H04R 2430/23; G10L 2021/02166
USPC ..... 381/300, 303, 307, 56, 313, 74, 92, 95, 381/103
See application file for complete search history.

(56) References Cited

U.S. PATENT DOCUMENTS 7,206,421 B1 * 4/2007 Taenzer ..... H04R 3/005 381/119
2017/0156017 A1 * 6/2017 Gamper ..... H04R 5/0335

* cited by examiner

*Primary Examiner* — Norman Yu
(74) *Attorney, Agent, or Firm* — Fenwick & West LLP

(57) ABSTRACT

An audio system presents spatialized audio content to a user that is individually calibrated for the user. The audio system presents sounds to the user, which reflects off the user's ear. An array of acoustic sensors of the audio system generate audio data from the presented sound. The audio system processes the audio data, using beamformers that each point to a respective portion of the ear, to generate beamformed signals. The audio system determines transfer functions that define transformations of the sound caused by reflections off the user's ear, using the beamformed signals. The audio system generates spatialized audio content for the ear based on the transfer functions.

20 Claims, 6 Drawing Sheets

INFERRING PINNAE INFORMATION VIA BEAM FORMING TO PRODUCE INDIVIDUALIZED SPATIAL AUDIO

BACKGROUND

The present disclosure generally relates to generating spatialized audio content for individual users.

Spatialized audio content may sound different for different users based on the shape and other acoustic properties of the ears of the user. For each ear, sound from a sound source is transformed via reflections from the pinna of the ear before arriving at the ear canal. It is possible to customize audio content that accounts for the transformation of sound by the user's ears using microphones placed at the ears to capture sound arriving at the ears, and computing a filter for how each ear transforms the sound. However, binaural microphones may impair the user's normal hearing, limiting the user's awareness of their surroundings. In addition, binaural microphones may be socially unacceptable and aesthetically unappealing.

SUMMARY

Embodiments relate to generating spatialized audio content that is individualized for a user based on audio data captured by a sensor array of acoustic sensors located remotely from the ears of the user. Some embodiments include a method for generating audio content for an ear. The method includes acoustic sensors of a sensor array generating audio data from one or more sounds received by the acoustic sensors. The audio data is processed using beamformers each pointing to a respective portion of a user's ear (e.g., a different location on the pinna of the ear) to generate beamformed signals. Transfer functions defining transformations of the sound caused by reflections from the portions of the ear are determined using the beamformed signals. Spatialized audio content for the ear is generated using the transfer functions. For example, an at-the-ear equalization filter may be determined using the transfer functions, and the spatialized audio content may be generated by transforming audio content for the ear using the at-the-ear equalization filter. A similar process may be performed for the other ear of the user to generate spatialized audio content for both the left and right ears that is individualized for the user.

Some embodiments include an audio system including a sensor array and an audio controller. The sensor array includes acoustic sensors configured to generate audio data from one or more sounds received by the acoustic sensors. The audio controller generates beamformed signals by processing the audio data using beamformers for the acoustic sensors, each beamformer pointing to a respective portion of an ear of a user. The audio controller determines transfer functions defining transformations of sound caused by reflections from the portions of the ear using the beamformed signals, and generates audio content for the ear using the transfer functions.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An audio system presents spatialized audio content to a user that is individualized for the user. For each ear, the audio system modifies audio content with an at-ear-equalization filter determined via capturing audio data with acoustic sensors located remotely from the ears of a user, and processing the audio data using beamformers pointed to multiple locations of the pinna of the ear. Spatialized audio content includes audio data that provides spatial cues by being different for the left and right ears. The user perceives the spatialized audio content as though they are physically located near a sound source producing the audio content because the spatialized audio content includes directionality and other spatial cues.

To capture binaural audio that has been transformed by the ears of the user, an audio system can use binaural acoustic sensors placed at each ear of the user. The differences between the sound at each ear of the user and the sound at the sound source may be used to determine filters for generating audio content that appears to originate from the direction of the sound source after reflections from the particular ears of the user. However, binaural microphones may prevent the user from fully being aware of their surroundings, as the microphones partially or completely occlude an entrance to an ear canal of the user.

Figure 1A:
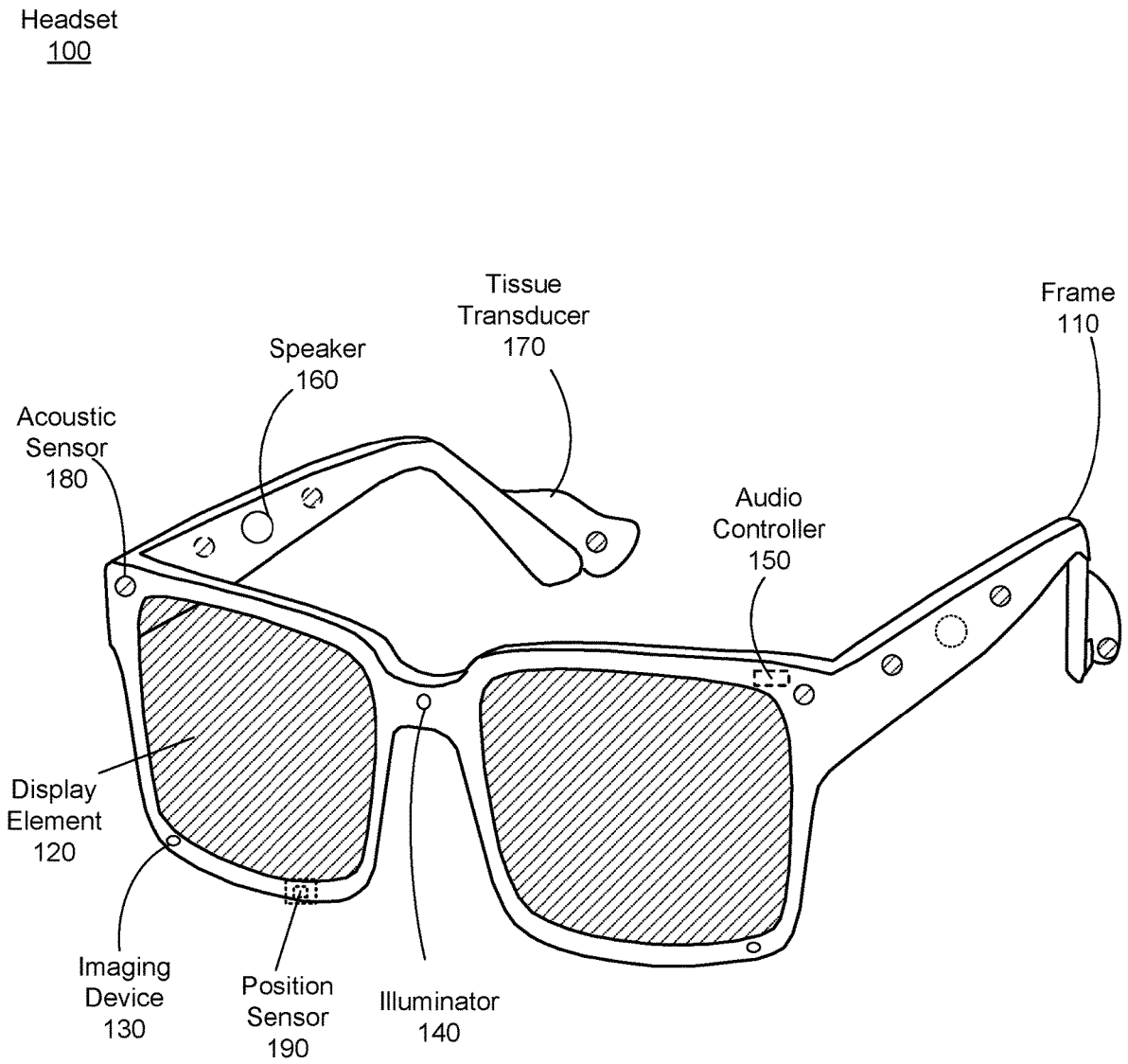
FIG. 1A is a perspective view of a headset, in accordance with one or more embodiments.

Embodiments include an audio system that generates spatialized audio content by determining at-ear equalization filters without the use of binaural microphones. The audio system uses beamformers that point to specific portions of a pinna of the user's ear. The audio system monitors how sound from a sound source is transformed when reflected off the portions of the pinna and determines transfer functions characterizing the sound transformations. By determining transfer functions corresponding to reflections off portions of the pinna, the system more accurately determines the effect of the pinna on sound produced by the sound source. The system correlates the transfer functions with an at-the-ear equalization filter that defines how the sound from a sound source, such as the speaker 160 of FIG. 1A, is perceived at an entrance to the user's ear canal. In effect, the at-the-ear equalization filter represents sound as it would be perceived by the entrance to the user's ear canal if the pinna did not cause reflections of sound. The system may adjust audio content using the at-the-ear equalization filter, such that the adjusted audio content appears to arrive from the direction of the sound source after reflection by the particular ear of the user. As such, the audio system minimizes distortions to spatial cues in the audio content, providing spatialized audio content that is individualized for the user.

In some embodiments, the system determines the at-the-ear equalization filters that best corresponds to the transfer functions of the reflections off the ear by referencing an at-the-ear equalization filter database. The database may include associations between acoustic transfer functions and at-ear-equalization filters.

The system captures sound using acoustic sensors of the sensor array, and determines the transfer functions corresponding to transformations of the sound at the ear canal caused by reflections from the user's pinnae. The system correlates the transfer functions with those stored in the database to determine an at-the-ear equalization filter that corresponds with or best corresponds with the transfer functions. The acoustic properties of the ears of different users may be different, thereby resulting in different transfer functions and a different at-the-ear equalization filter. As such, transforming audio content using the at-the-ear equalization filter preserves individual spatial cues and individual equalization for the audio content.

In some embodiments, each of the at-the-ear equalization filters in the database may be generated by placing an inner ear acoustic sensor, e.g., an acoustic sensor at an entrance to an ear canal of a user's ear, capturing sound from a sound source, and determining a transformation between the captured sound and the sound at the sound source. The inner ear acoustic sensor generates audio data indicating the perception of sound at the entrance to the ear canal. Each of the at-the-ear equalization filters may be correlated to a set of transfer functions that determine how the pinna of the user's ear transforms sound. Different directions of arrival may correspond with different at-the ear equalization filters and transfer functions for each ear. The database may also store at-the-ear equalization filters and transfer functions corresponding to multiple individuals. In some embodiments, the database may include multiple at-the-ear equalization filters and transfer functions for a single individual.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

System Overview

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

Note that in some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides spatialized audio content to the user. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). The speakers 160 may be enclosed in the frame 110. In some embodiments, the headset 100 includes a speaker array comprising multiple speakers integrated into the frame 110 to improve directionality of presented audio content. In some embodiments, the speakers 160 may each be placed within an ear canal of the user. The speakers 160 may be positioned at other locations of the headset 100. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 adjusts audio content and instructs the transducer array to present spatialized audio content to the user. The audio controller 150 adjusts audio content as per at-the-ear equalization filters that capture the response of a pinna of the user's ear to an audio signal. The audio controller 150 uses beamformers to detect reflections of sound from specific locations of the pinna and characterizes the transformation of sound due to the reflections as transfer functions. The transfer functions map to at-the-ear equalization filters that the audio controller 150 uses in rendering spatialized audio content that is individualized for the user.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIGS. 2-5.

Figure 1B:
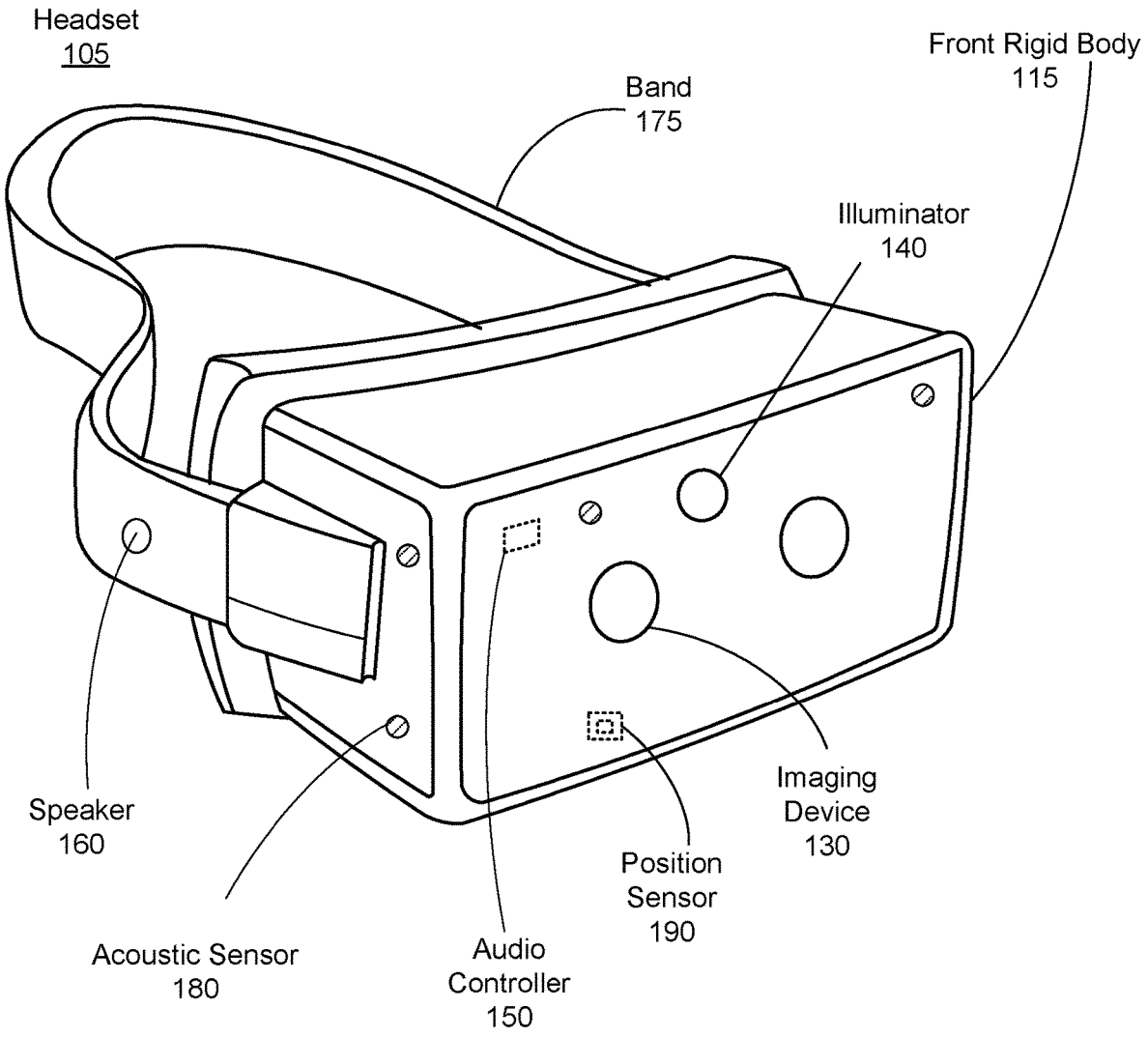
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190.

Figure 2:
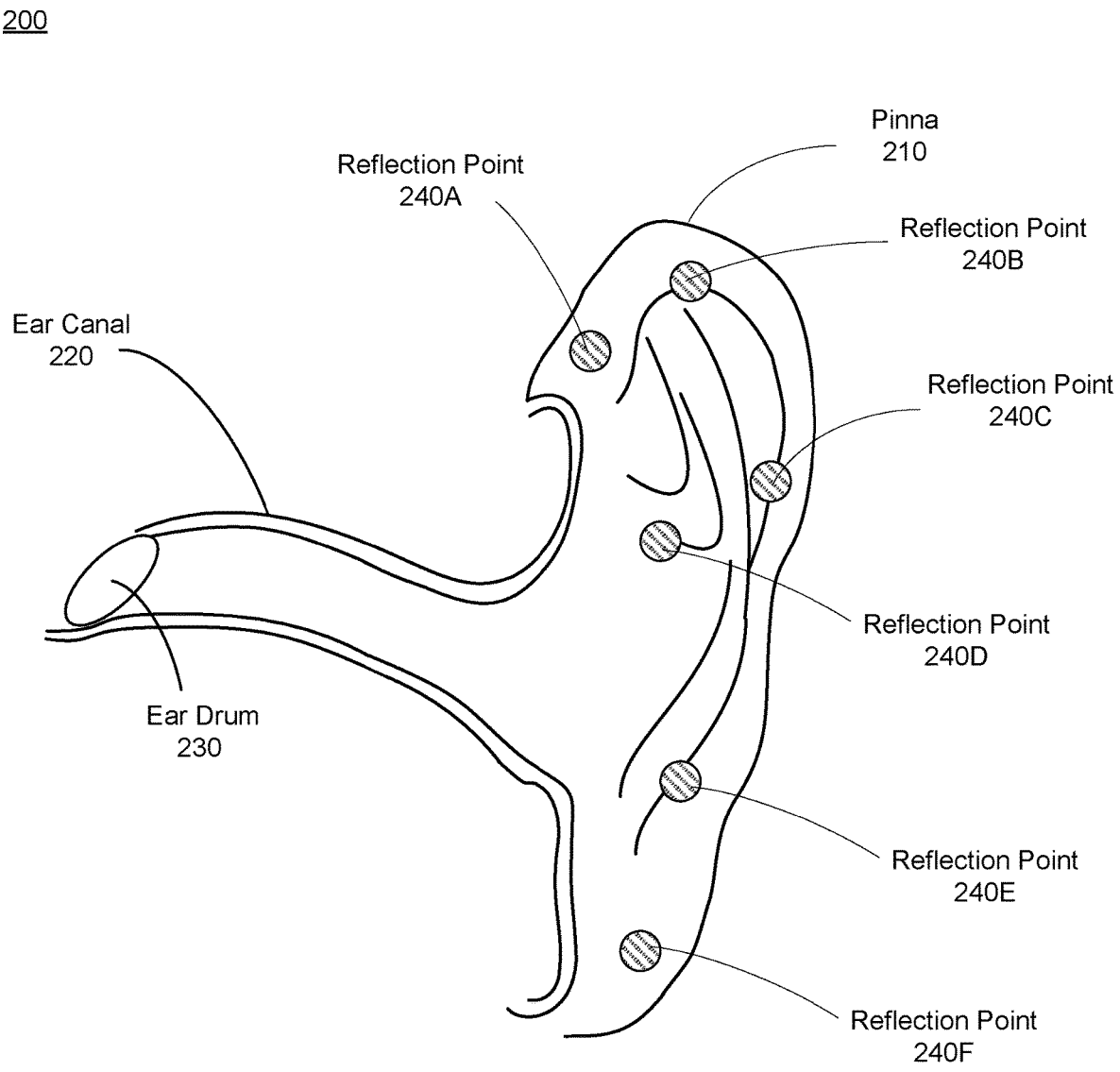
FIG. 2 is a cross-sectional view of an ear of a user showing reflection points on portions of the ear, in accordance with one or more embodiments.

FIG. 2 is a cross-sectional view 200 of an ear of a user showing reflection points on portions of the ear, in accordance with one or more embodiments. The ear comprises a pinna 210, an ear canal 220, and an ear drum 230. A number of reflection points 240A-F are positioned on various portions of the pinna.

A headset, such as the headset 100 and/or the headset 105, produces beamformers, that are each configured to point at a part of the pinna 210 of the user's ear. A beamformer is a part of an audio system configured to isolate an audio signal specific to a location. In some embodiments, a beamformer may isolate an audio signal specific to a sound source. Each of the beamformers may point to a portion of the pinna 210 corresponding to each of the reflection points 240A-F. A controller of the headset may generate the beamformers.

A transducer array of the headset or some other sound source produces sound that reflects off of the user's pinna, from the reflection points 240A-F. The reflected sound may be characterized by transfer functions associated with each beamformed signal's location. The controller may determine, from the plurality of transfer functions associated with the reflections off the user's pinna, how the sound may be perceived at the center of the user's ear relative to a position of the headset. The center of the user's ear may be an entrance to the ear canal 220. The controller may query a database of transfer functions correlated with "at-the-ear" equalization filters to find the at-the-ear equalization filter that may be the best match for the user. The at-the-ear equalization filter characterizes how sound is perceived at the entrance to the ear canal 220. The determination of at-the-ear equalization filters is further discussed with respect to FIGS. 3-4. The controller may adjust and present audio content to the user accordingly. For each ear, a different direction of arrival for a sound may include different transfer functions for each of the reflection points 240 and a different at-the-ear equalization filter. In some embodiments, reflections off the user's pinna may result in a different transfer functions for each of the reflection points 240 and a different at-the-ear equalization filter.

Figure 3:
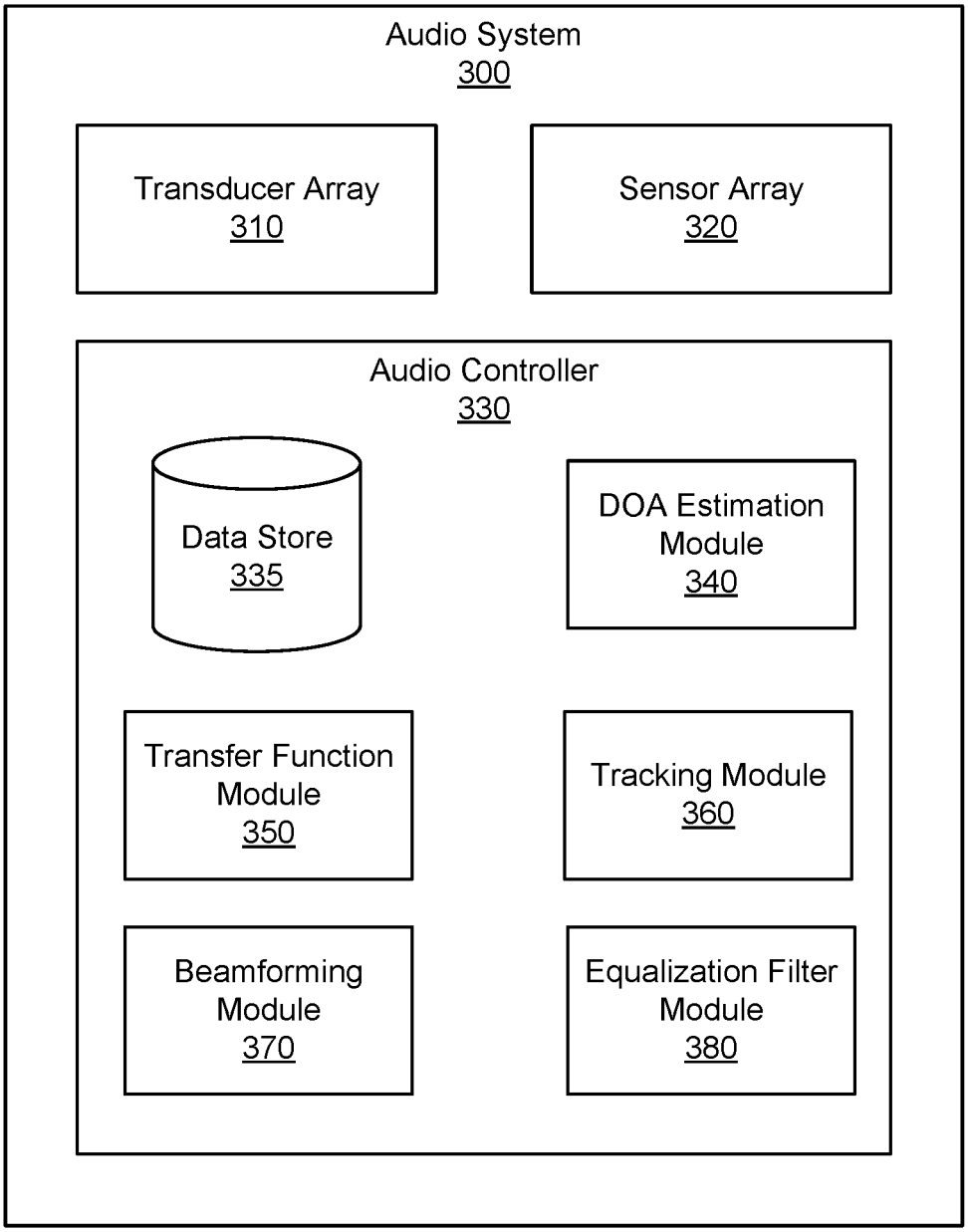
FIG. 3 is a block diagram of an example audio system, in accordance with one or more embodiments.

FIG. 3 is a block diagram of an example audio system 300, in accordance with one or more embodiments. The audio system in FIG. 1A or FIG. 1B may be an embodiment of the audio system 300. The audio system 300 provides individualized and spatialized audio content for the user by modifying audio content with at-ear-equalization filters determined via capturing audio data with acoustic sensors of the sensor array 320 located remotely from the ears of a user. The sensors of the sensor array 320 capture sound that reflects off of several portions of a pinna of the user (e.g., the reflection points shown in FIG. 2) using beamformers pointed at each of the portions of the pinna. The audio system 300 generates an acoustic transfer function corresponding to each of the reflection points and determines, from the acoustic transfer functions, an at-the-ear equalization filter that defines the transformation of the sound from the sound source to the center of the user's ear. Based on the at-the-ear equalization filter, the audio system 300 adjusts audio content for an ear of the user. The audio system 300 may perform a similar process for both ears to generate the spatialized audio content that is individualized for the particular shape and other acoustic properties of the user's ears. In the embodiment of FIG. 3, the audio system 300 includes a transducer array 310, a sensor array 320, and an audio controller 330. Some embodiments of the audio system 300 have different components than those described here. Similarly, in some cases, functions can be distributed among the components in a different manner than is described here.

The transducer array 310 is configured to present audio content. At least a portion of the sound produced by the transducer array 310 is received by the acoustic sensors in the sensor array 320. The transducer array 310 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 310 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 310 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 330, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 310 generates sound in accordance with instructions from the audio controller 330. For example, the audio content may be a linear sweep, logarithmic sweep, white noise, pink noise, a maximum length signal, an arbitrary signal, or some combination thereof. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 300. The transducer array 310 may be coupled to a wearable device (e.g., the headset 100 or the headset 105). In alternate embodiments, the transducer array 310 may be a plurality of speakers that are separate from the wearable device (e.g., coupled to an external console).

The sensor array 320 detects sounds. The sounds may be from within a local area surrounding the user of the headset, produced by the transducer array 310 of the headset, or some combination thereof. The sensor array 320 may include a plurality of acoustic sensors that each detect air pressure variations of a sound wave and convert the detected sounds into acoustic content in an electronic format (analog or digital). The plurality of acoustic sensors may be positioned on a headset (e.g., headset 100 and/or the headset 105), on a user (e.g., in an ear canal of the user), on a neckband, or some combination thereof. In some embodiments, the acoustic sensors of the sensor array are located in positions remote from the ear canal of the user. An acoustic sensor may be, e.g., a microphone, a vibration sensor, an accelerometer, or any combination thereof. In some embodiments, the sensor array 320 is configured to monitor the audio content generated by the transducer array 310 using at least some of the plurality of acoustic sensors. Increasing the number of sensors may improve the accuracy of information (e.g., directionality) describing a sound field produced by the transducer array 310 and/or sound from the local area.

The audio controller 330 controls operation of the audio system 300. In particular, the audio controller 330 determines transfer functions that characterize a response of a user's pinna to sound and determines an at-the-ear equalization function that will help produce spatialized audio content. In the embodiment of FIG. 3, the audio controller 330 includes a data store 335, a DOA estimation module 340, a transfer function module 350, a tracking module 360, a beamforming module 370, and an equalization filter module 380. The audio controller 330 may be located inside a headset, in some embodiments. Some embodiments of the audio controller 330 have different components than those described here. Similarly, functions can be distributed among the components in different manners than described here. For example, some functions of the controller may be performed external to the headset.

The data store 335 stores data for use by the audio system 300. Data in the data store 335 may include sounds recorded in the local area of the audio system 300, audio content, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 300, or any combination thereof. The data store 335 may also store at-the-ear equalization filters, once they are determined, in a database of at-the-ear equalization filters, along with a set of associated transfer functions. Each of the stored at-the-ear equalization filters may be associated with a shape of a user's pinna, a location of the user, a sound source, or a combination thereof. The data store 335 may also store transfer functions characterizing a response of a user's pinna to sound. In some embodiments, for each DOA estimation and for each ear, the data store 335 stores a plurality of transfer functions, each corresponding to a location on the user's pinna, and an at-ear equalization filter.

The DOA estimation module 340 is configured to localize sound sources in the local area based in part on information from the sensor array 320. Localization is a process of determining where sound sources are located relative to the user of the audio system 300. The DOA estimation module 340 performs a DOA analysis to localize one or more sound sources within the local area. The DOA analysis may include analyzing the intensity, spectra, and/or arrival time of each sound at the sensor array 320 to determine the direction from which the sounds originated. In some cases, the DOA analysis may include any suitable algorithm for analyzing a surrounding acoustic environment in which the audio system 300 is located.

For example, the DOA analysis may be designed to receive input signals from the sensor array 320 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 320 received the direct-path audio signal. The determined angle may then be used to identify the DOA for the received input signal. Other algorithms not listed above may also be used alone or in combination with the above algorithms to determine DOA.

In some embodiments, the DOA estimation module 340 may also determine the DOA with respect to an absolute position of the audio system 300 within the local area. The position of the sensor array 320 may be received from an external system (e.g., some other component of a headset, an artificial reality console, a mapping server, a position sensor (e.g., the position sensor 190), etc.). The external system may create a virtual model of the local area, in which the local area and the position of the audio system 300 are mapped. The received position information may include a location and/or an orientation of some or all of the audio system 300 (e.g., of the sensor array 320). The DOA estimation module 340 may update the estimated DOA based on the received position information.

The transfer function module 350 is configured to generate one or more acoustic transfer functions. Generally, a transfer function is a mathematical function giving a corresponding output value for each possible input value. Based on parameters of the detected sounds, the transfer function module 350 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives sound that is reflected off a pinna of the user's ear, i.e., the transformation of sound caused by reflections off portions of the user's pinna.

An ATF includes a number of transfer functions that characterize a relationship between the sound source and the corresponding sound received by the acoustic sensors in the sensor array 320. Accordingly, for a sound source there is a corresponding transfer function for each of the acoustic sensors in the sensor array 320. And collectively the set of transfer functions is referred to as an ATF. Accordingly, for each sound source there is a corresponding ATF. Note that the sound source may be, e.g., someone or something generating sound in the local area, the user, or one or more transducers of the transducer array 310. The ATF for a particular sound source location relative to the sensor array 320 may differ from user to user due to a person's anatomy (e.g., ear shape, shoulders, etc.) that affects the sound as it travels to the person's ears. Accordingly, the ATFs of the sensor array 320 are personalized for each user of the audio system 300. The ATFs of the sensor array 320 may be used in determining a measure of sound pressure at a center of the user's ear, such as at an entrance to the user's ear canal.

The transfer function module 350 may determine an ATF characterizing the transformation of sound by comparing the audio data generated by the acoustic sensors in the sensor array 320 with and without reflections from the ear. The transfer function module 350 instructs the transducer array 310 to present sound while the user is wearing the headset. Beamformers, discussed in further detail with respect to the beamforming module, enhance the sounds that are reflected off of portions of the user's pinna. The acoustic sensors of the sensor array 320 generate audio data corresponding to sound detected by the beamformers, via beamformed signals. The transfer function module 350 also instructs the transducer array 310 to present sound while the user is not wearing the headset. The beamformers point to the same locations, but as the user is not wearing the headset, the sound does not reflect off the user's pinna. The sensor array generates audio data that captures the sound without reflections off the user's ear. The transfer function module 350 generates calibration signals, using the beamformed signals, that correspond to the audio data detected without reflection. The transfer function module 350 determines the ATF by comparing the beamformed signals and the calibration signals. In some embodiments, calibration, i.e., capturing the sound without reflections off the user's ear, may be done in an anechoic chamber. In some embodiments, acoustic data capturing the sound that reflects off the user's pinna may be determined using a head and/or torso simulator.

The tracking module 360 is configured to track locations of one or more sound sources. The tracking module 360 may compare current DOA estimates and compare them with a stored history of previous DOA estimates. In some embodiments, the audio system 300 may recalculate DOA estimates on a periodic schedule, such as once per second, or once per millisecond. The tracking module may compare the current DOA estimates with previous DOA estimates, and in response to a change in a DOA estimate for a sound source, the tracking module 360 may determine that the sound source moved. In some embodiments, the tracking module 360 may detect a change in location based on visual information received from the headset or some other external source. The tracking module 360 may track the movement of one or more sound sources over time. The tracking module 360 may store values for a number of sound sources and a location of each sound source at each point in time. In response to a change in a value of the number or locations of the sound sources, the tracking module 360 may determine that a sound source moved. The tracking module 360 may calculate an estimate of the localization variance. The localization variance may be used as a confidence level for each determination of a change in movement.

The beamforming module 370 is configured to process one or more ATFs to selectively emphasize sounds from sound sources within a certain area while de-emphasizing sounds from other areas. In analyzing sounds detected by the sensor array 320, the beamforming module 370 may combine information from different acoustic sensors to emphasize sound associated from a particular region of the local area while deemphasizing sound that is from outside of the region. The beamforming module 370 may isolate an audio signal associated with sound from a particular sound source from other sound sources in the local area based on, e.g., different DOA estimates from the DOA estimation module 340 and the tracking module 360. The beamforming module 370 may thus selectively analyze discrete sound sources in the local area. In some embodiments, the beamforming module 370 may enhance a signal from a sound source. For example, the beamforming module 370 may apply sound filters which eliminate signals above, below, or between certain frequencies. Signal enhancement acts to enhance sounds associated with a given identified sound source relative to other sounds detected by the sensor array 320.

The beamforming module 370 may generate beamformers that each point to a part of the user's pinna (e.g., the reflection points 240). In some embodiments, the beamformers may be configured to sweep around the pinna or around the entirety of the user's ear. The beamformed signals may enhance the sounds reflected off the portions of the pinna, which are detected by the acoustic sensors of the sensor array 320. The beamforming module 370 may generate beamformers based on maximum directivity, minimum variance distortionless response, linearly constrained minimum variance, or some combination thereof.

The equalization filter module 380 determines at-the-ear equalization filters and adjusts audio content accordingly. The adjusted audio content may be spatialized audio content that is customized for an individual user. In one embodiment, at-the-ear equalization filters specific to a user may be determined by placing an in-ear acoustic sensor at an entrance to an ear canal of the user's ear, i.e., a center of the ear. The in-ear acoustic sensor may be a part of the sensor array 320. The audio data generated by the in-ear acoustic sensor may be used to determine a transformation characterizing a response at the center of the ear relative the sound at the source. The at-the-ear equalization filter may be stored in the data store 335 in a database of at-the-ear equalization filters. Each of the at-the-ear equalization filters correspond with a set of transfer functions that characterize how sound is transformed by a user's pinnae. The database of at-the-ear equalization filters and transfer functions determined from a plurality of users. In some embodiments, a single user may have a number of at-the-ear equalization filters and associated transfer functions stored in the database.

In some embodiments, an at-the-ear equalization filter for a user's ear may be determined by referencing the database of at-the-ear equalization filters stored in the data store 335. The transfer function module 350 may determine an ATF characterizing the transformations of the sound at each reflection point of the pinna, wherein the equalization filter module 380 subsequently correlates the ATF with a reference at-the-ear equalization filter stored in the database. The transfer functions associated with the at-the-ear equalization filter may match the ATF exactly and/or closely. The at-the-ear equalization filters may vary based on the type of sound received by the user's ear, the shape of the user's pinna, the location of the user, or some combination thereof. Referencing a database of at-the-ear equalization filters eliminates the need for an in-ear acoustic sensor. Rather, the response at the center of the user's ear may be detected remotely by detecting the transformation of sound from reflections off the user's pinna surrounding the center of the user's ear. Finding a close matching at-the-ear equalization filter may be automated by the use of a trained neural network that takes as input the ATF and outputs the appropriate at-the-ear equalization filter.

In some embodiments, the at-the-ear equalization filters cause the audio content to be spatialized, such that the audio content appears to originate from a target region or a direction of arrival. The equalization filter module 380 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the equalization filter module 380 calculates one or more of the acoustic parameters. In some embodiments, the equalization filter module 380 requests the acoustic parameters from a mapping server (e.g., as described below with regard to FIG. 5).

The equalization filter module 380 may provide spatialized audio content generated using the at-the-ear equalization filters to the transducer array 310, which presents the spatialized audio content to the user accordingly. The spatialized audio content may include audio content that is different for the left and right ears, thereby providing spatial cues.

Figure 4:
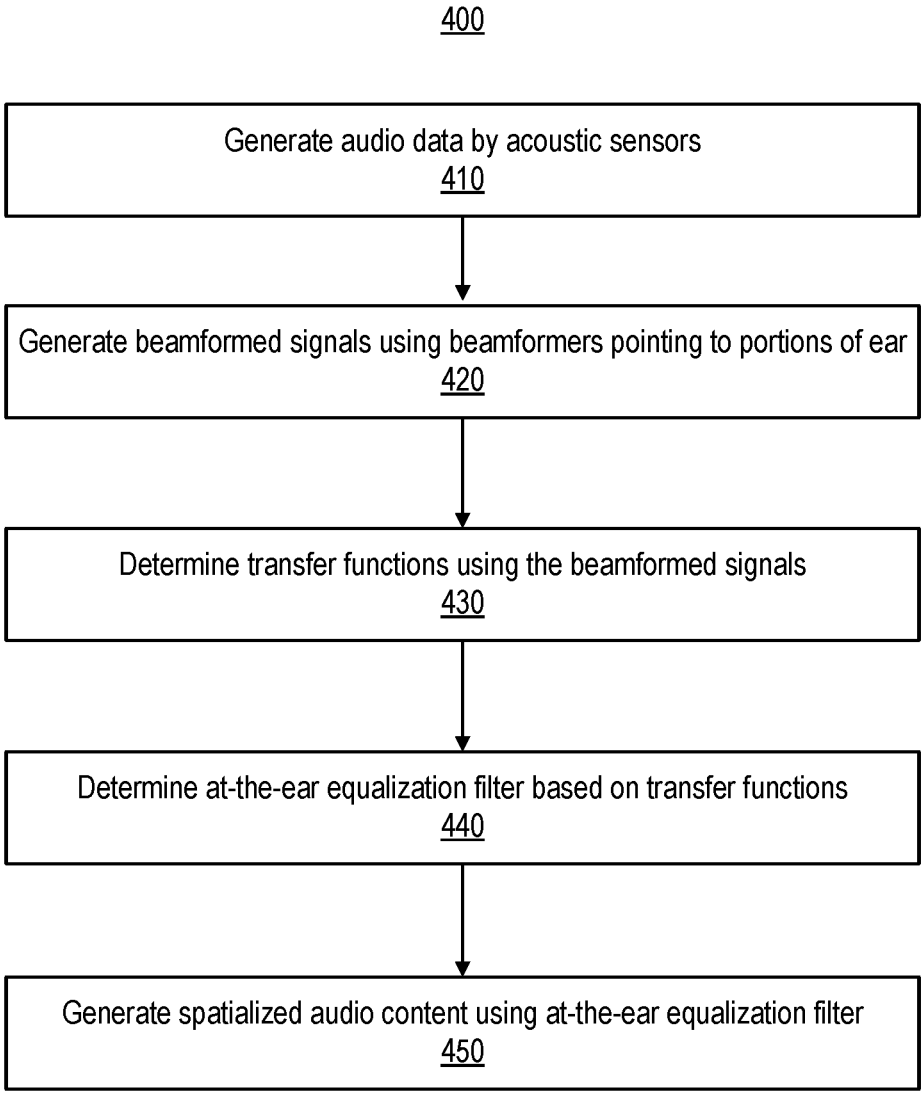
FIG. 4 is a flowchart of a process for producing spatialized audio content that is individualized for the ears of a user, in accordance with one or more embodiments

FIG. 4 is a flowchart of a process 400 for producing spatialized audio content that is individualized for the ears of a user, in accordance with one or more embodiments. The process may be carried out by an audio system, e.g., the audio system 300, coupled to a headset (e.g., the headset 100 and/or the headset 105). Other entities may perform some or all of the steps of the process in other embodiments (e.g., a console). Likewise, embodiments may include different and/or additional steps, or perform the steps in different orders.

The audio system generates 410 audio data using acoustic sensors of a sensor array. For example, the acoustic sensors generate the audio data by converting one or more sounds into electrical signals. The one or more sounds may be generated by a sound source and arrive at the acoustic sensors from a particular direction of arrival. The one or more sounds may be generated by the audio system (e.g., one or more transducers of the transducer array 310) or may be generated by one or more sound sources separate from the audio system.

The audio system generates 420 beamformed signals by processing the audio data using beamformers for the acoustic sensors of the sensor array. Each of the beamformers points to a different portion of a pinna of the user's ear, such that the beamformed signals correspond to the reflections of sound from the portions of the pinna. The beamformed signals may be generated from one or more sounds. For example, the audio system may generate a sound, in response to which the audio system may apply each of the beamformers. In another embodiment, the audio system may generate a plurality of sounds, wherein a beamformer is applied to each sound to systematically cover different portions of the pinna. The beamformers may sequentially and systematically cover different portions of the pinna, such that the beamformers sweep across the user's ear. For example, the audio system may generate a first sound, in response to which the acoustic sensors of the sensor array may generate corresponding first audio data. A first beamformer may point to a first portion of the ear, which the audio system may use in processing the first audio data to generate a first beamformed signal. This process may repeat for multiple sounds and beamformers, until beamformed signals from a large portion of the pinna is covered. The beamformed signals collectively may indicate a measure of sound pressure at the center of the user's ear.

In some embodiments, the sounds produced by the audio system may be presented to the user via tissue conduction. In such cases, the beamformed signals correspond to transformations of sound due to vibrations of different portions of the pinna.

The audio system determines 430 transfer functions using the beamformed signals. The transfer functions define transformations of sound caused by reflections from the different portions of the pinna of the ear of the user. Each portion of the pinna and beamformed signal may correspond with a different transfer function. In some embodiments, the transfer functions may be determined by a comparison of the beamformed signals and calibration signals defining sound from the sound source without reflection from the portions of the pinna of the ear. The audio system may generate the calibration signals, in which the same beamformers are used without the user wearing the headset. The audio system may process the audio data generated by the acoustic sensors in this manner to determine the calibration signals. The transfer functions are used to generate spatialized audio content for the ear, as discussed in greater detail below. In some embodiments, the audio system may produce sound that reflects off portions of the pinna of the ear. The reflections of sound off the pinna are processed by the acoustic sensors to generate the audio data. The transfer functions for reflections off each portion of the pinna may be determined by deconvolving the audio data corresponding to the reflection for the portion of the ear with the audio system produced sound.

The audio system determines 440 an at-the-ear equalization filter for the ear based on the transfer functions. The at-the-ear equalization filter defines a transformation of sound at the center (e.g., ear canal) of the user's ear that is individualized for the user. In some embodiments, the audio system may use the transfer functions to look up a database of reference at-the-ear-equalization filters, and determine a matching or best matching at-the-ear equalization filter for the determined transfer functions. Each of the reference at-the-ear equalization filters stored within the database may be associated with a different set of transfer functions.

The audio system may determine the set of transfer functions stored in the database by using at least one acoustic sensor of the sensor array positioned within an ear of a user. The acoustic sensor may be placed at an entrance of an ear canal of the user's ear. A sound source generates one or more sounds. A pinna of the user's ear reflects the sound. The acoustic sensor at the entrance of the user's ear canal produces audio data capturing how the sound is perceived at a center of the user's ear, while the acoustic sensors of the sensor array away from the ear capture the reflections of the sound off the pinna. The audio system determines a set of transfer functions characterizing the transformation of the sound due to the reflections off the pinna. The audio system correlates the transfer functions with the response at the center of the ear to determine at-ear equalization filters for the set of transfer functions. The audio system stores, in the database, the at-ear equalization filters and associated transfer functions for future reference.

The audio system generates 450 spatialized audio content for the ear using the at-the-ear equalization filter. Furthermore, the audio system may present the spatialized audio content to the ear, such as to a transducer located at the ear. The process 400 may be repeated, such for the other ear of the user. In one example, the process 400 is performed in parallel for the left and right ears to generate spatialized audio content for both ears. Different ears may include different beamformed signals and transfer functions, thus resulting in a different at-ear-equalization filter for each ear.

Figure 5:
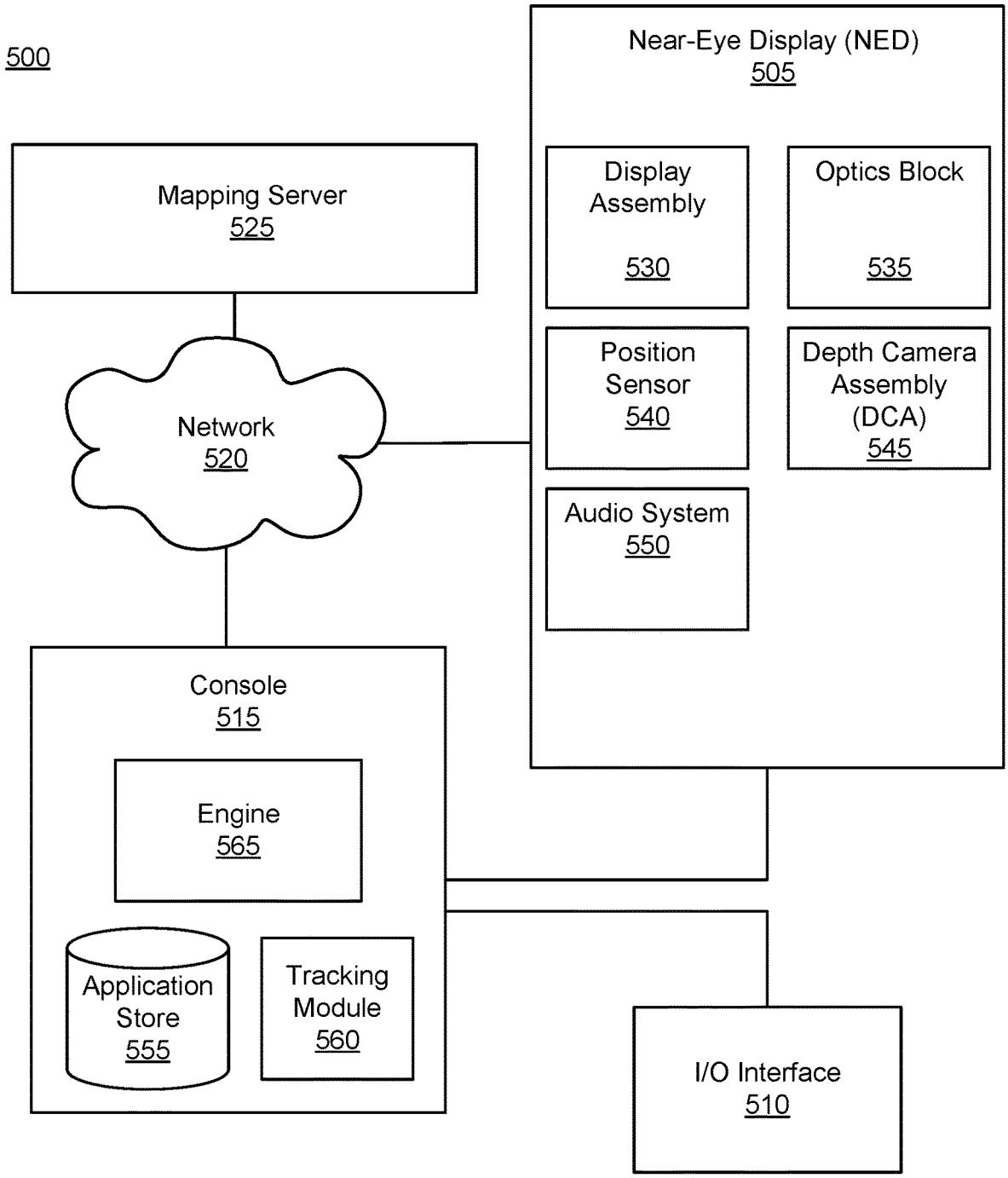
FIG. 5 is a block diagram of an example artificial reality system, in accordance with one or more embodiments.

FIG. 5 is a block diagram of an example artificial reality system 500, in accordance with one or more embodiments. The system 500 includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUs, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides spatialized audio content to a user of the headset 505. The audio system 550 is substantially the same as the audio system 300 describe above. The audio system 550 may comprise one or more acoustic sensors, one or more transducers, and an audio controller. The audio system 550 may provide spatialized audio content to the user by inferring the response of audio content at the center of the user's ears using audio data captured by the acoustic sensors of the sensor array located remotely from the ears of the user. The audio system 550 may determine transfer functions based on reflections of sound off the user's pinnae, correlate the transfer functions to an at-the-ear equalization filter, and generate spatial audio content presented to the user accordingly.

In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like, in relation to manufacturing processes. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described (e.g., in relation to manufacturing processes.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

generating, by acoustic sensors of a sensor array, audio data from one or more sounds received by the acoustic sensors;

generating beamformed signals by processing the audio data using beamformers, each beamformer pointing to a different portion of an ear of a user;

determining transfer functions defining transformations of the sound caused by reflections from the different portions of the ear using the beamformed signals; and generating spatialized audio content for the ear based on the transfer functions.

2. The method of claim 1, wherein generating the spatialized audio content based on the transfer functions includes:

determining an at-the-ear equalization filter based on the transfer functions; and adjusting audio content for the user using the at-the-ear equalization filter.

3. The method of claim 2, wherein determining the at-the-ear equalization filter includes referencing a database of reference at-the-ear equalization filters.

4. The method of claim 2, wherein determining the at-the-ear equalization filter includes correlating the transfer functions to a filter calibrated for the user.

5. The method of claim 1, wherein determining the transfer functions defining transformations of the sound caused by reflections from the portions of the ear using the beamformed signals includes:

generating, by the acoustic sensors of the sensor array, other audio data from one or more other sounds received by the acoustic sensors without reflection from the portions of the ear;

generating calibration signals by processing the other audio data using the beamformers; and determining the transfer functions using the beamformed signals and the calibration signals.

6. The method of claim 1, wherein:

at least one acoustic sensor of the sensor array is positioned at an entrance of an ear canal of the ear of the user; and determining the transfer functions defining transformations of the sound caused by reflections from the portions of the ear using the beamformed signals includes:

generating, by the at least one acoustic sensor of the sensor array, other audio data from one or more other sounds received by the at least one acoustic sensor; and determining the transfer functions using the beamformed signals and the other audio data.

7. The method of claim 1, wherein the beamformed signals collectively indicate a measure of sound pressure at a center of the ear of the user.

8. The method of claim 1, further comprising generating, by at least one transducer, the one or more sounds received by the acoustic sensors.

9. The method of claim 1, wherein each beamformer points to a different portion of a pinna of the ear.

10. The method of claim 1, further comprising:

generating a first beamformer of the beamformers pointing to a first portion of the ear;

generating first audio data of the audio content by the acoustic sensors of the sensor array from a first sound of the one or more sounds; and processing the first audio data using the first beamformer to generate a first beamformed signal of the beamformed signals.

11. An audio system comprising:

a sensor array including acoustic sensors, the acoustic sensors configured to:

generate audio data from one or more sounds received by the acoustic sensors; and an audio controller configured to:

generate beamformed signals by processing the audio data using beamformers for the acoustic sensors of the sensor array, each beamformer pointing to a different portion of an ear of a user;

determine transfer functions defining transformations of the sound caused by reflections from the different portions of the ear using the beamformed signals; and generate spatialized audio content for the ear based on the transfer functions.

12. The audio system of claim 11, wherein the audio controller is further configured to:

determine an at-the-ear equalization filter based on the transfer functions; and adjust audio content using the at-the-ear equalization filter.

13. The audio system of claim 12, wherein the audio controller is further configured to reference a database of reference at-the-ear equalization filters.

14. The audio system of claim 12, wherein the audio controller is further configured to correlate the transfer functions to a filter calibrated for the user.

15. The audio system of claim 11, wherein the audio controller is further configured to:

generate, by the acoustic sensors of the sensor array, other audio data from one or more other sounds received by the acoustic sensors without reflection from the portions of the ear;

generate calibration signals by processing the other audio data using the beamformers; and determine the transfer functions using the beamformed signals and the calibration signals.

16. The audio system of claim 11, wherein:

at least one acoustic sensor of the sensor array is positioned at an entrance of an ear canal of the ear of the user; and the audio controller is further configured to:

generate, by the at least one acoustic sensor of the sensor array, other audio data from one or more other sounds received by the at least one acoustic sensor; and determine the transfer functions using the beamformed signals and the other audio data.

17. The audio system of claim 11, wherein the beamformed signals collectively indicate a measure of sound pressure at a center of the ear of the user.

18. The audio system of claim 11, wherein each beamformer points to a different portion of a pinna of the ear.

19. A computer readable non-transitory storage medium storing instructions for presenting spatialized audio content, the instructions, when executed by a processor, cause the processor to perform steps comprising:

generating, by acoustic sensors of a sensor array, audio data from one or more sounds received by the acoustic sensors;

generating beamformed signals by processing the audio data using beamformers, each beamformer pointing to a different portion of an ear of a user;

determining transfer functions defining transformations of the sound caused by reflections from the different portions of the ear using the beamformed signals; and generating spatialized audio content for the ear based on the transfer functions.

20. The computer readable non-transitory storage medium of claim 19, wherein the instructions further cause the processor to perform steps comprising:

determining an at-the-ear equalization filter based on the transfer functions; and adjusting audio content for the user using the at-the-ear equalization filter.

* * * * *